US009306292B2

(12) United States Patent
Ryu

(10) Patent No.: US 9,306,292 B2
(45) Date of Patent: Apr. 5, 2016

(54) PORTABLE TERMINAL

(71) Applicant: LG ELECTRONICS INC., Seoul (KR)

(72) Inventor: Seungwoo Ryu, Uijeongbu (KR)

(73) Assignee: LG ELECTRONICS INC., Seoul (KR)

( * ) Notice: Subject to any disclaimer, the term of this patent is extended or adjusted under 35 U.S.C. 154(b) by 289 days.

(21) Appl. No.: 13/757,292

(22) Filed: Feb. 1, 2013

(65) Prior Publication Data

US 2013/0207854 A1 Aug. 15, 2013

(30) Foreign Application Priority Data

Feb. 15, 2012 (KR) ..... 10-2012-0015448

(51) Int. Cl.

| | |
|---|---|
| ***H01Q 1/24*** | (2006.01) |
| ***H01Q 21/28*** | (2006.01) |
| ***H01Q 1/52*** | (2006.01) |
| ***H01Q 5/35*** | (2015.01) |

(52) U.S. Cl.

CPC ..... *H01Q 21/28* (2013.01); *H01Q 1/243* (2013.01); *H01Q 1/521* (2013.01); *H01Q 5/35* (2015.01)

(58) Field of Classification Search

CPC ..... H01Q 5/0048; H01Q 1/521; H01Q 1/243
USPC ..... 343/702, 841, 893, 853
See application file for complete search history.

(56) References Cited

U.S. PATENT DOCUMENTS

| | | | | |
|---|---|---|---|---|
| 7,764,236 | B2 * | 7/2010 | Hill et al. | 343/702 |
| 2007/0268190 | A1 * | 11/2007 | Huynh | 343/702 |
| 2008/0278384 | A1 * | 11/2008 | Shimasaki | H01Q 1/2266 343/702 |
| 2008/0316115 | A1 * | 12/2008 | Hill et al. | 343/702 |
| 2009/0189817 | A1 * | 7/2009 | Yang et al. | 343/702 |
| 2010/0302110 | A1 * | 12/2010 | Leem | 343/702 |
| 2011/0215971 | A1 * | 9/2011 | Rao | 343/702 |
| 2011/0273342 | A1 * | 11/2011 | Park et al. | 343/702 |
| 2011/0291895 | A1 * | 12/2011 | Zaila et al. | 343/702 |
| 2012/0056789 | A1 * | 3/2012 | Sohn | 343/702 |
| 2013/0057438 | A1 | 3/2013 | Satou et al. | |
| 2013/0057446 | A1 | 3/2013 | Hirobe et al. | |

FOREIGN PATENT DOCUMENTS

| | | | |
|---|---|---|---|
| CA | 2377921 | A1 | 1/2001 |
| DE | 19929689 | A1 | 1/2001 |
| WO | 2011/105650 | A1 | 9/2011 |
| WO | 2011/142135 | A1 | 11/2011 |
| WO | 2011/145324 | A1 | 11/2011 |

* cited by examiner

*Primary Examiner* — Dameon E Levi
*Assistant Examiner* — Hasan Islam
(74) *Attorney, Agent, or Firm* — Birch, Stewart, Kolasch & Birch, LLP

(57) ABSTRACT

The present disclosure relates to a portable terminal having antennas for transmitting or receiving wireless signals. The portable terminal includes a terminal body, a first antenna mounted in the terminal body to transmit or receive a wireless signal, a second antenna disposed with being spaced apart from the first antenna and set to transmit or receive a wireless signal at a frequency band different from the first antenna, and a connection unit configured to electrically connect the first and second antennas to reduce a frequency interference between the first and second antennas, at least part of the connection unit being formed along an edge of the terminal body.

11 Claims, 15 Drawing Sheets

PORTABLE TERMINAL

CROSS-REFERENCE TO RELATED APPLICATION

Pursuant to 35 U.S.C. §119(a), this application claims the benefit of earlier filing date and right of priority to Korean Application No. 10-2012-0015448, filed on Feb. 15, 2012, the contents of which is incorporated by reference herein in its entirety.

BACKGROUND OF THE INVENTION

1. Field of the Invention

This specification relates to a portable terminal having antennas for transmitting and receiving wireless signals.

2. Background of the Invention

Terminals may be divided into mobile/portable terminals and stationary terminals according to their mobility. Mobile terminals (mobile device, portable device, portable terminal) can be easily carried and have one or more of functions such as supporting voice and video telephony calls, inputting and/or outputting information, storing data and the like.

As it becomes multifunctional, the portable terminal can be allowed to capture still images or moving images, play music or video files, play games, receive broadcast and the like, so as to be implemented as a multimedia player.

Various new attempts have been made for the multimedia devices by hardware or software in order to implement such complicated functions. For example, a user interface environment is provided in order for users to easily and conveniently retrieve or select functions.

Furthermore, because a portable terminal is considered as a personal belonging for expressing one's own personality, various design forms are required. The design forms include structural changes and improvements for the user to more conveniently use the portable terminal.

In recent time, to apply a multiple input multiple output (MIMO) technology, a plurality of antennas are installed in a portable terminal. However, when a distance between antennas is reduced to mount the plurality of antennas on a narrow space within the portable terminal, a coupling coefficient increases due to an increase in a level of electromagnetic coupling between the antennas. Therefore, an approach capable of minimizing interference between antennas even if the antennas are mounted within a close distance.

SUMMARY OF THE INVENTION

Therefore, an aspect of the detailed description is to provide a portable terminal capable of reducing an interference between antennas disposed adjacent to each other.

Another aspect of the detailed description is to provide a portable terminal capable of improving an isolation of each antenna using a portion exposed to an outer appearance of the portable terminal.

To achieve these and other advantages and in accordance with the purpose of this specification, as embodied and broadly described herein, there is provided a portable terminal including a terminal body, a first antenna mounted in the terminal body to transmit or receive a wireless signal, a second antenna disposed with being spaced apart from the first antenna and set to transmit or receive a wireless signal at a frequency band different from the first antenna, and a connection unit configured to electrically connect the first and second antennas to reduce a frequency interference between the first and second antennas, at least part of the connection unit being formed along an edge of the terminal body.

In accordance with one exemplary embodiment of the detailed description, the connection unit may include a first connection portion formed along a side surface of the terminal body and made of a conductive material, and a second connection portion disposed between the first and second antennas and the first connection portion to electrically connect the first and second antennas to the first connection portion.

In accordance with one exemplary embodiment of the detailed description, the second connection portion may be formed integrally with the first connection portion and protrude from the first connection portion into the terminal body, or may be implemented as a flexible printed circuit board or a cable formed separate from the first connection portion.

In accordance with one exemplary embodiment of the detailed description, the second connection portion may be a neutralization line.

In accordance with one exemplary embodiment of the detailed description, the first connection portion may be mounted onto one surface of a case of the terminal body.

In accordance with one exemplary embodiment of the detailed description, a printed circuit board may be mounted in the terminal body to process wireless signals of the first and second antennas, the first and second antennas may include first and second feed parts connected to the printed circuit board, respectively, and the connection unit may be electrically connected to a portion adjacent to the first feed part and a portion adjacent to the second feed part, respectively.

In accordance with one exemplary embodiment of the detailed description, the first and second antennas may include first and second ground parts connected to the ground, respectively, and one end of the connection unit may be connected to portions adjacent to the first and second ground parts, respectively.

In accordance with one exemplary embodiment of the detailed description, the connection unit may be connected to a portion adjacent to the feed part or a portion adjacent to the ground part of the first antenna connected to the printed circuit board, which is mounted in the terminal body for processing a wireless signal of the first antenna, and connected to a portion adjacent to the feed part or a portion adjacent to the ground part of the second antenna connected to the is printed circuit board, which is mounted in the terminal body for processing a wireless signal of the second antenna.

In accordance with one exemplary embodiment of the detailed description, the first and second antennas may be disposed along one side of a side surface of the terminal body with a spaced distance therebetween, and the connection unit may be formed along the one side to electrically connect the first and second antennas to each other.

In accordance with one exemplary embodiment of the detailed description, at least part of the connection unit may be curved from one side of the side surface of the terminal body toward another side perpendicular to the one side, and the connection unit may extend to a third antenna disposed along the one side to electrically connect the second antenna and the third antenna to each other.

In accordance with one exemplary embodiment of the detailed description, at least one of the first and second antennas may be disposed at positions adjacent to the connection unit, with a spaced distance therebetween, so as to be coupled to the connection unit.

In accordance with another exemplary embodiment of the detailed description, there is provided a portable terminal including a terminal body having a front surface, a side surface and a rear surface, a window disposed on the front surface, a metal member formed to be exposed to the outside of at least one of the front surface, the side surface and the rear surface, the metal member made of a conductive material to provide a different type of texture from the window, a plurality of antennas mounted in the terminal body to transmit or receive wireless signals, respectively, and an extending portion extending from the metal member into the terminal body to be connected to the plurality of antennas, respectively.

In accordance with one exemplary embodiment of the detailed description, the metal member exposed to the outside of the terminal body may form a closed loop along an edge of the terminal body.

In accordance with one exemplary embodiment of the detailed description, the metal member may be electrically connected to the plurality of antennas, respectively, at both ends thereof, and a logo may be formed between the both ends, so as to be exposed to at least one of the front surface and the rear surface of the terminal body.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of an antenna device and a portable terminal having the same according to the exemplary embodiments, with reference to the accompanying drawings. For the sake of brief description with reference to the drawings, the same or equivalent components will be provided with the same reference numbers, and description thereof will not be repeated. A singular representation may include a plural representation as far as it represents a definitely different meaning from the context.

A portable terminal disclosed herein may include a portable phone, a smart phone, a laptop computer, a digital broadcast terminal, a personal digital assistant (PDA), a portable multimedia player (PMP), a navigator, and the like. However, it may be easily understood by those skilled in the art that the configuration according to the exemplary embodiments of this specification can be applied to stationary terminals such as digital TV, desktop computers and the like excluding a case of being applicable only to the mobile terminals.

Figure 1:
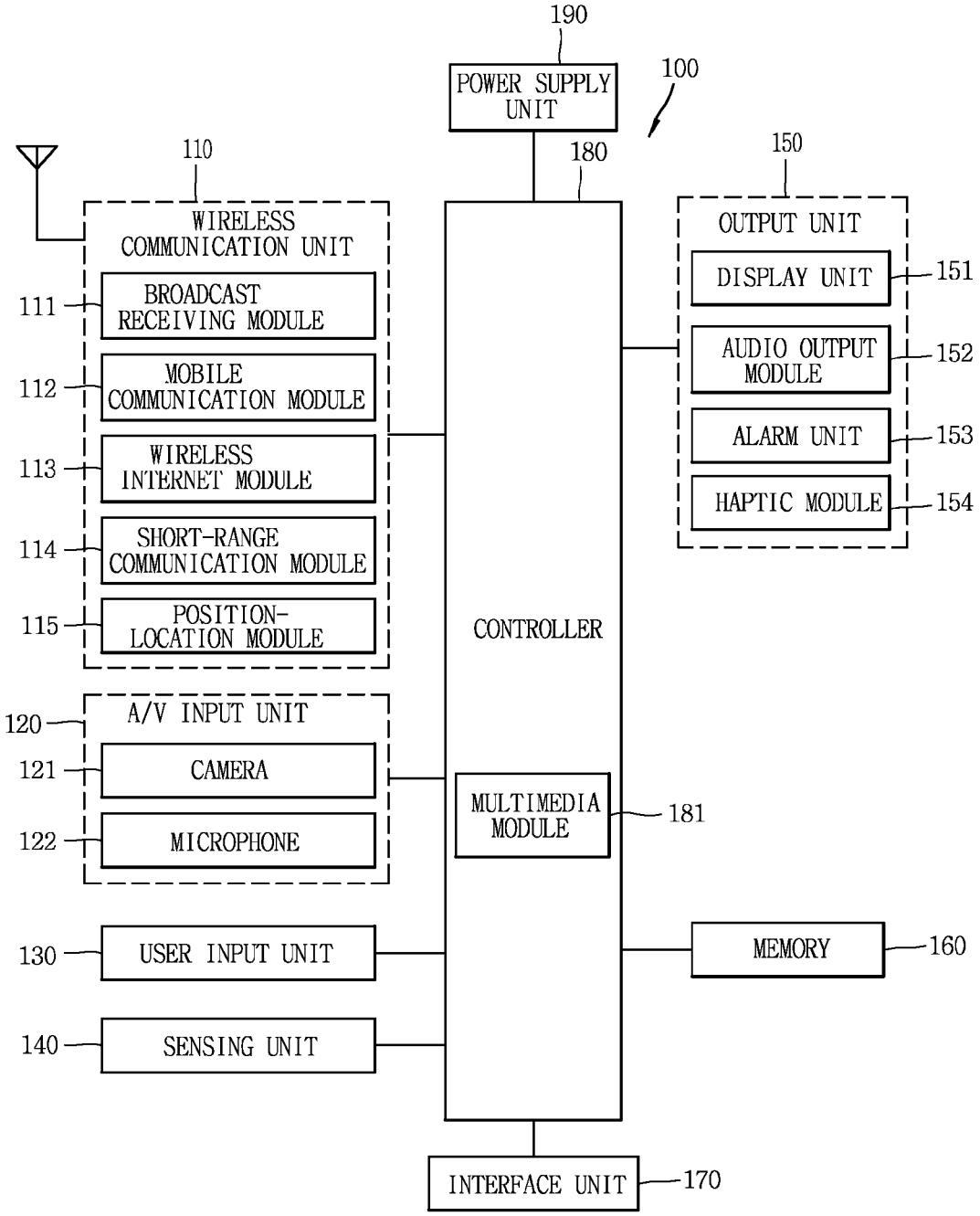
FIG. 1 is a block diagram of a portable (mobile) terminal in accordance with one exemplary embodiment.

FIG. 1 is a block diagram illustrating a portable terminal associated with an exemplary embodiment.

The portable terminal 100 may include a wireless communication unit 110, an Audio/Video (A/V) input unit 120, a user input unit 130, a sensing unit 140, an output unit 150, a memory 160, an interface unit 170, a controller 180, a power supply unit 190, and the like. However, all of the elements as illustrated in FIG. 1 are not necessarily required, and the portable terminal may be implemented with greater or less number of elements than those illustrated elements.

Hereinafter, the constituent elements will be described in turn.

The wireless communication unit 110 typically includes one or more elements allowing radio communication between the portable terminal 100 and a wireless communication system, or allowing radio communication between the portable terminal 100 and a network in which the portable terminal 100 is located. For example, the wireless communication unit 110 may include a broadcast receiving module 111, a mobile communication module 112, a wireless Internet module 113, a short-range communication module 114, a location information module 115, and the like.

The broadcast receiving module 111 receives broadcast signals and/or broadcast associated information from an external broadcast management server through a broadcast channel.

The broadcast channel may include a satellite channel and/or a terrestrial channel. The broadcast management server may mean a server that generates and transmits a broadcast signal and/or broadcast associated information or a server that receives a previously generated broadcast signal and/or broadcast associated information and transmits to the portable terminal 100. The broadcast signal may include a TV broadcast signal, a radio broadcast signal and a data broadcast signal as well as a broadcast signal in a form that a data broadcast signal is coupled to the TV or radio broadcast signal.

The broadcast associated information may mean information regarding a broadcast channel, a broadcast program, a broadcast service provider, and the like. The broadcast associated information may also be provided through a mobile communication network, and in this case, the broadcast associated information may be received by the mobile communication module 112.

The broadcast associated information may exist in various forms. For example, it may exist in the form of an electronic program guide (EPG) of digital multimedia broadcasting (DMB), electronic service guide (ESG) of digital video broadcast-handheld (DVB-H), and the like.

The broadcast receiving module 111 may receive a broadcast signal using various types of broadcast systems. In particular, the broadcast receiving module 111 may receive a digital broadcast signal using a digital broadcast system such to as digital multimedia broadcasting-terrestrial (DMB-T), digital multimedia broadcasting-satellite (DMB-S), media forward link only (MediaFLO), digital video broadcast-handheld (DVB-H), integrated services digital broadcast-terrestrial (ISDB-T), and the like. The broadcast receiving module 111 is, of course, configured to be suitable for every broadcast system that provides a broadcast signal as well as the above-mentioned digital broadcast systems.

Broadcast signals and/or broadcast associated information received via the broadcast receiving module 111 may be stored in a suitable device, such as a memory 160.

The mobile communication module 112 transmits and/or receives a radio signal to and/or from at least one of a base station, an external terminal and a server over a mobile communication network. In this exemplary embodiment, the radio signal may include a voice call signal, a video call signal and/or various types of data according to text and/or multimedia message transmission and/or reception.

The wireless Internet module 113 is a module for supporting wireless Internet access. The wireless Internet module 113 may be built-in or externally installed to the portable terminal 100. In this exemplary embodiment, the wireless Internet module 113 may use a wireless Internet access technique including a Wireless LAN (WLAN), Wi-Fi, Wireless Broadband (Wibro), World Interoperability for Microwave Access (Wimax), High Speed Downlink Packet Access (HSDPA), and the like.

The short-range communication module 114 is a module for supporting a short-range communication. In this exemplary embodiment, it may be used a short-range communication technology including Bluetooth, Radio Frequency IDentification (RFID), Infrared Data Association (IrDA), Ultra WideBand (UWB), ZigBee, and the like.

The location information module 115 is a module for checking or acquiring a location of the portable terminal, such as a GPS module.

Referring to FIG. 1, the A/V input unit 120 receives an audio or video signal, and the NV input unit 120 may include a camera 121 and a microphone 122. The camera 121 processes an image frame, such as still picture or video, obtained by an image sensor in a video phone call or image capturing mode. The processed image frame may be displayed on a display unit 151.

The image frames processed by the camera 121 may be stored in the memory 160 or transmitted to an external device through the wireless communication unit 110. Two or more cameras 121 may be provided according to the use environment of the portable terminal.

The microphone 122 receives an external audio signal through a microphone in a phone call mode, a recording mode, a voice recognition mode, and the like, and processes the audio signal into electrical voice data. The processed voice data may be converted and outputted into a format that is transmittable to a mobile communication base station through the mobile communication module 112 in the phone call mode. The microphone 122 may implement various types of noise canceling algorithms to cancel noise generated in a procedure of receiving the external audio signal.

The user input unit 130 may generate input data to control an operation of the terminal. The user input unit 130 may be configured by including a keypad, a dome switch, a touch pad (pressure/capacitance), a jog wheel, a jog switch, and the like.

The sensing unit 140 detects a current status of the portable terminal 100 such as an opened or closed state of the portable terminal 100, a location of the portable terminal 100, existence or non-existence of a user contact, an orientation of the portable terminal 100 and the like, and generates a sensing signal for controlling the operation of the portable terminal 100. For example, when the is portable terminal 100 is a slide phone type, it may sense an opened or closed state of the slide phone. Furthermore, the sensing unit 140 takes charge of a sensing function associated with whether or not power is supplied from the power supply unit 190, or whether or not an external device is coupled to the interface unit 170. On the other hand, the sensing unit 140 may include a proximity sensor 141.

The output unit 150 is configured to provide an output for audio signal, video signal, or alarm signal, and the output unit 150 may include the display unit 151, an audio output module 152, an alarm unit 153, a haptic module 154, and the like.

The display unit 151 may display (output) information processed in the portable terminal 100. For example, when the portable terminal 100 is in a phone call mode, the display unit 151 may display a User Interface (UI) or a Graphic User Interface (GUI) associated with a call. When the portable terminal 100 is in a video call mode or image capturing mode, the display unit 151 may display a captured image and/or received image, a UI or GUI.

The display unit 151 may include at least one of a Liquid Crystal Display (LCD), a Thin Film Transistor-LCD (TFT-LCD), an Organic Light Emitting Diode (OLED) display, a flexible display, and a three-dimensional (3D) display.

Some of those displays may be configured with a transparent or optical transparent type to allow viewing of the exterior through the display unit, and such displays may be called transparent displays. An example of a typical transparent display may include a transparent LCD (TOLED), and the like. Under this configuration, a user can view an object positioned at a rear side of a terminal body through a region occupied by the display unit 151 of the terminal body.

The display unit 151 may be implemented in two or more in number according to a configured aspect of the portable terminal 100. For instance, a plurality of the display units 151 may be arranged on one surface to be spaced apart from or integrated with each other, or may be arranged on different surfaces.

In embodiments where the display unit 151 and a touch sensitive sensor (referred to as a touch sensor) have an interlayer structure, the structure may be referred to as a touch screen. The display unit 151 may be used as an input device in addition to being used as an output device. The touch sensor may be implemented as a touch film, a touch sheet, a touch pad, and the like.

The touch sensor may be configured to convert changes of a pressure applied to a specific part of the display unit 151, or a capacitance occurring from a specific part of the display unit 151, into electric input signals. Also, the touch sensor may be configured to sense not only a touched position and a touched area, but also a touch pressure.

When touch inputs are sensed by the touch sensors, corresponding signals are transmitted to a touch controller (not shown). The touch controller processes the received signals, and then transmits corresponding data to the controller 180. Accordingly, the controller 180 may sense which region of the display unit 151 has been touched.

Referring to FIG. 1, a proximity sensor 141 may be arranged at an inner region of the portable terminal 100 covered by the touch screen, or near the touch screen. The proximity sensor may sense a presence or absence of an object approaching a surface to be sensed, or an object disposed near a surface to be sensed, by using an electromagnetic field or infrared rays without a mechanical contact. The proximity sensor has a longer lifespan and a more enhanced utility is than a contact sensor.

The proximity sensor may include an optical transmission type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and so on. When the touch screen is implemented as a capacitance type, proximity of a pointer to the touch screen is sensed by changes of an electromagnetic field. In this case, the touch screen (touch sensor) may be categorized into a proximity sensor.

Hereinafter, for the sake of convenience of brief explanation, a status that the pointer is positioned to be proximate onto the touch screen without contact will be referred to as 'proximity touch', whereas a status that the pointer substantially comes in contact with the touch screen will be referred to as 'contact touch'. For the position corresponding to the proximity touch of the pointer on the touch screen, such position corresponds to a position where the pointer faces perpendicular to the touch screen upon the proximity touch of the pointer.

The proximity sensor senses proximity touch, and proximity touch patterns (e.g., distance, direction, speed; time, position, moving status, etc.). Information relating to the sensed proximity touch and the sensed proximity touch patterns may be output onto the touch screen.

The audio output module 152 may output audio data received from the wireless communication unit 110 or stored in the memory 160 in a call-receiving mode, a call-placing mode, a recording mode, a voice recognition mode, a broadcast reception mode, and the like. The audio output module 152 may output audio signals relating to functions performed in the portable terminal 100, e.g., sound alarming a call received or a message received, and so on. The audio output module 152 may include a receiver, a speaker, a buzzer, and so on.

The alarm unit 153 outputs signals notifying occurrence of events from the portable terminal 100. The events occurring from the portable terminal 100 may include a call received, a message received, a key signal input, a touch input, and the like. The alarm unit 153 may output not only video or audio signals, but also other types of signals such as signals notifying occurrence of events in a vibration manner. Since the video or audio signals can be output through the display unit 151 or the audio output unit 152, the display unit 151 and the audio output module 152 may be categorized into a part of the alarm unit 153.

The haptic module 154 generates various tactile effects which a user can feel. A representative example of the tactile effects generated by the haptic module 154 includes vibration. Vibration generated by the haptic module 154 may have a controllable intensity, a controllable pattern, and so on. For instance, different vibration may be output in a synthesized manner or in a sequential manner.

The haptic module 154 may generate various tactile effects, including not only vibration, but also arrangement of pins vertically moving with respect to a skin being touched (contacted), air injection force or air suction force through an injection hole or a suction hole, touch by a skin surface, presence or absence of contact with an electrode, effects by stimulus such as an electrostatic force, reproduction of cold or hot feeling using a heat absorbing device or a heat emitting device, and the like.

The haptic module 154 may be configured to transmit tactile effects (signals) through a user's direct contact, or a user's muscular sense using a finger or a hand. The haptic module 154 may be implemented in two or more in number according to the configuration of the portable terminal 100.

The memory 160 may store a program for the processing and control of the controller 180. Alternatively, the memory 160 may temporarily store input/output data (e.g., phonebook data, messages, still images, video and the like). Also, the memory 160 may store data related to various patterns of vibrations and audio output upon the touch input on the touch screen.

The memory 160 may be implemented using any type of suitable storage medium including a flash memory type, a hard disk type, a multimedia card micro type, a memory card type (e.g., SD or DX memory), Random Access Memory (RAM), Static Random Access Memory (SRAM), Read-Only Memory (ROM), Electrically Erasable Programmable Read-only Memory (EEPROM), Programmable Read-only Memory (PROM), magnetic memory, magnetic disk, optical disk, and the like. Also, the portable terminal 100 may operate a web storage which performs the storage function of the memory 160 on the Internet.

The interface unit 170 may generally be implemented to interface the portable terminal 100 with external devices. The interface unit 170 may allow a data reception from an external device, a power delivery to each component in the portable terminal 100, or a data transmission from the portable terminal 100 to an external device. The interface unit 170 may include, for example, wired/wireless headset ports, external charger ports, wired/wireless data ports, memory card ports, ports for coupling devices having an identification module, audio Input/Output (I/O) ports, video I/O ports, earphone ports, and the like.

The identification module may be configured as a chip for storing various information required to authenticate an authority to use the portable terminal 100, which may include a User Identity Module (UIM), a Subscriber Identity Module (SIM), and the like. Also, the device having the identification module (hereinafter, referred to as 'identification device') may be implemented in a type of smart card. Hence, the identification device can be coupled to the portable terminal 100 via a port.

Also, the interface unit 170 may serve as a path for power to be supplied from an external cradle to the portable terminal 100 when the portable terminal 100 is connected to the external cradle or as a path for transferring various command signals inputted from the cradle by a user to the portable terminal 100. Such various command signals or power inputted from the cradle may operate as signals for recognizing that the portable terminal 100 has accurately been mounted to the cradle.

The controller 180 typically controls the overall operations of the portable terminal 100. For example, the controller 180 performs the control and processing associated with telephony calls, data communications, video calls, and the like. The controller 180 may include a multimedia module 181 which provides multimedia playback. The multimedia module 181 may be configured as part of the controller 180 or as a separate component.

The controller 180 can perform a pattern recognition processing so as to recognize writing or drawing input on the touch screen as text or image. The power supply unit 190 provides power required by various components under the control of the controller 180.

Various embodiments described herein may be implemented in a computer-readable medium using, for example, software, hardware, or some combination thereof.

For a hardware implementation, the embodiments described herein may is be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, micro processors, other electronic units designed to perform the functions described herein, or a selective combination thereof. In some cases, such embodiments are implemented by the controller 180.

For software implementation, the embodiments such as procedures and functions may be implemented together with separate software modules each of which performs at least one of functions and operations. The software codes can be implemented with a software application written in any suitable programming language. Also, the software codes may be stored in the memory 160 and executed by the controller 180.

Figure 2A:
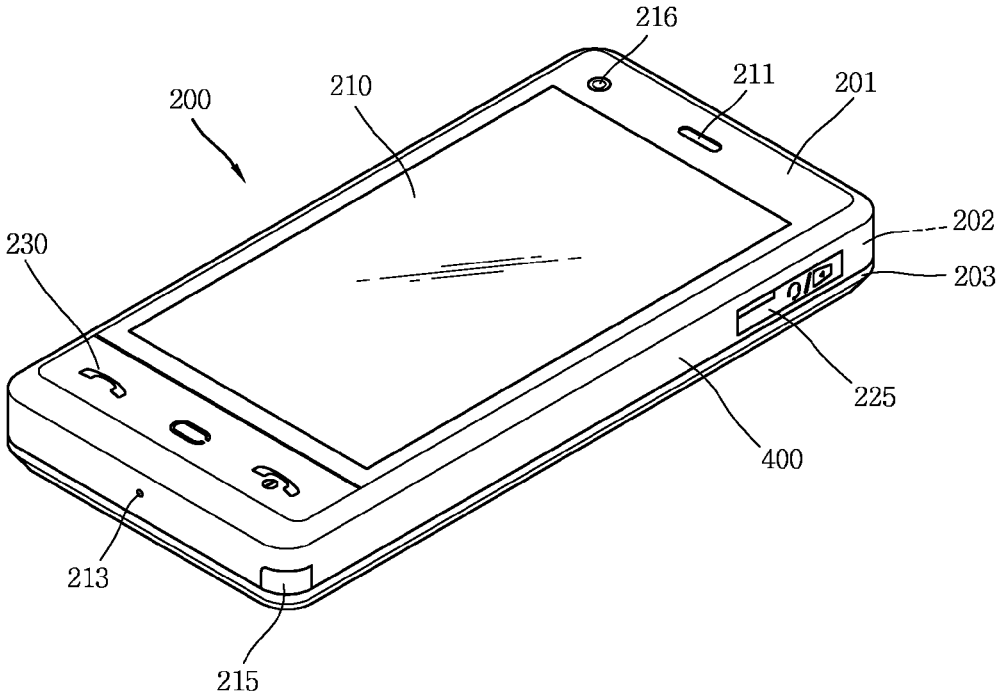
FIG. 2A is a front perspective view of an example of a portable terminal according to the present disclosure.
Figure 2B:
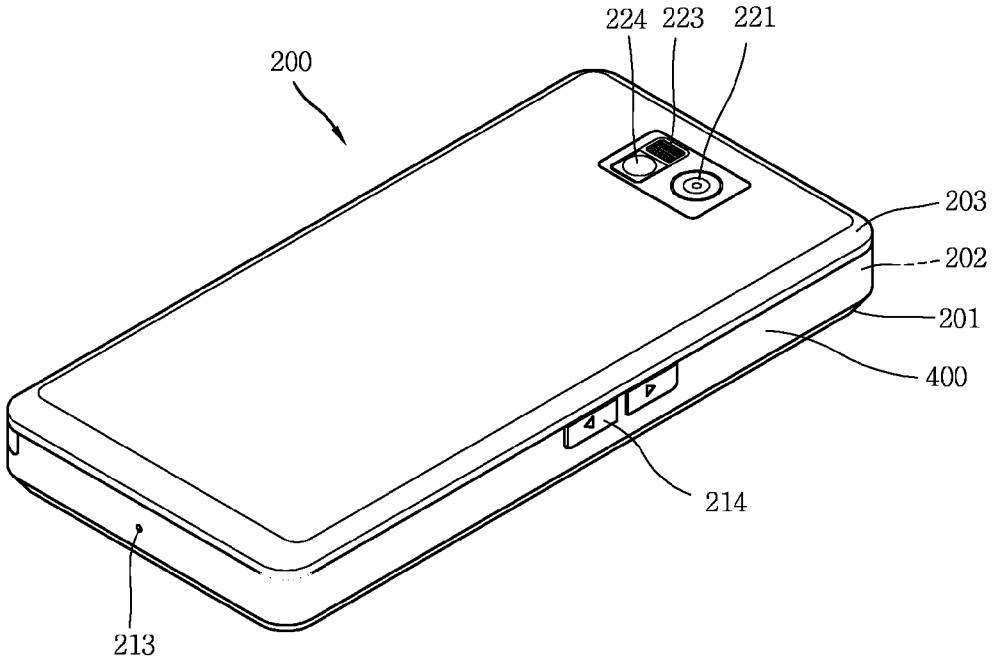
FIG. 2B is a rear perspective view of the portable terminal shown in FIG. 2A.

Referring to FIGS. 1, 2A and 2B, the portable terminal (or mobile terminal) 100, 200 has a bar type terminal body. However, the present invention is not limited thereto and may be applicable to a slide type mobile terminal, a folder type mobile terminal, a swing type mobile terminal, a swivel type mobile terminal, etc, in which two or more bodies are combined to be relatively movable. In addition, the mobile terminal disclosed in this specification may be applied to portable electronic devices having a camera and a flash, for example, a cellular phone, a smart phone, a notebook computer, a digital broadcasting terminal, personal digital assistants (PDA), a portable multimedia plate (PMO), and the like.

The terminal body includes a case (or casing, housing, cover, etc.) constituting the external appearance. In this embodiment, the case may include a front case 201 and a rear case 203 shielding an opposite surface to the front case 201. A middle case 202 may be interposed between the front case 201 and the rear case 203. Various electronic components are installed in the space between the front case 201 and the rear case 203. The cases may be formed by injection-molding a synthetic resin or may be made of a metallic material such as stainless steel (STS) or titanium (Ti), etc.

A power supply unit 241, a rear camera 221 and a second audio output module 225 may be disposed on the rear surface of the terminal body.

The power supply unit 241 may supply power to the portable terminal 200. The power supply unit 241 may be installed within the terminal body or may be directly attached to or detached from the exterior of the terminal body.

A flash 223 may be disposed adjacent to the rear case 221. The flash 223 may illuminate an object to be captured when capturing the object using the rear camera 221.

A mirror 224 may be disposed adjacent to the flash 224. The mirror 224 may allow a user to see himself when he wants to capture his own image (i.e., self-image capturing) by using the rear camera 221.

The second audio output module 225 may implement stereophonic sound functions in conjunction with the first audio output module 211 disposed on the front surface of the terminal body and may also be used for implementing a speaker phone mode for call communication.

The rear camera 221 may have an image capture direction which is substantially opposite to that of the front camera 216 disposed on the front surface, and have a different number of pixels than the front camera 216.

For example, the front camera 216 may have a smaller number of pixels to capture an image of the user's face and transmit such image to another party, is and the rear camera 221 may preferably have a larger number of pixels to capture an image of a general object and not immediately transmit it in most cases. The front and rear cameras 216 and 221 may be installed on the terminal body such that they can be rotatable or popped up.

A side key 214, an interface unit 215, 225, a sound input unit 213 and the like may be disposed on the side surface of the front case 201.

The side key 214 may be referred to as a manipulation unit, and receive commands for controlling operations of the portable terminal 200. The side key 214 may employ any tactile manner that a user can touch or tap for manipulation. Contents input by the side key 214 may be set variously. For example, the side key 214 may allow for receiving commands, such as control of the image input unit 216, 230, volume control of sound output from the audio output module 211, 225, conversion into a touch recognition mode of the display unit 210 and the like.

The sound input unit 213 may be implemented as a type of microphone, for example, for receiving user's voice and other sounds.

The interface unit 215, 225 may serve as a path for data exchange between the portable terminal 200 and external devices. For example, the interface unit 215, 225 may be at least one of wired/wireless earphone ports, ports for short-range communication (e.g., IrDA, Bluetooth, WLAN, etc.), power supply terminals for power supply to the portable terminal and the like. The interface unit 215, 225 may be a card socket for coupling to external cards, such as a Subscriber Identity Module (SIM), a User Identity Module (UIM), a memory card for storage of information and the like.

A display unit 210, a first audio output module 211, a signal input unit 230 and a front camera 216 may be disposed on the front surface of the terminal body.

The display unit 210 may include a liquid crystal display (LCD) module, an organic light emitting diodes (OLED) module, an e-paper and the like for displaying visual information. The display unit 210 may include a touch sensing unit for receiving touch inputs. Hereinafter, the display unit 210 having the touch sensing unit may be referred to as 'touch screen.' When a touch input is sensed on a portion on the touch screen 210, contents corresponding to the touched position may be inputted. The contents inputted in the touching manner may be text or numerals, or instructions or menu items which may be indicated or set in various modes. The touch sensing unit may be transparent such that the display unit can be visible, and include a structure for enhancing visibility of the touch screen at a bright place. Referring to FIG. 2A, the touch screen 210 may occupy most of the front surface of the front case 201.

The first audio output module 211 may be implemented as a receiver to transfer a call sound to a user's ear, or a loud speaker for outputting various alarm sounds or multimedia reproduction sounds.

The front camera 216 may receive and process image frames of still pictures or video obtained by image sensors in a video call mode or a capturing mode. The processed image frames may be displayed on the display unit 151.

The image frames processed by the front camera 216 may be stored in the memory 160 or transmitted to an external device through the wireless communication unit 110. Two or more front cameras 216 may be provided according to the use environment of the portable terminal.

The signal input unit 230 may be manipulated to allow inputting of commands for controlling operations of the portable terminal 200, and include a plurality of input keys. The plurality of input keys may be referred to as a is manipulating portion. Such manipulating portion can employ any tactile manner that a user can touch or tap for manipulation.

For instance, the manipulating portion may be implemented as a dome switch, a touch screen, a touchpad or the like by which a user can input commands or information in a pushing or touching manner. Alternatively, the manipulating portion may be implemented as a wheel or a jog which rotates keys or a joystick. Contents inputted by the signal input unit 230 may be set in various manners. For example, the signal input unit 230 may be to input commands such as START, END, SCROLL or the like.

The terminal body may include an antenna for call communication and also additionally have a broadcasting signal reception antenna. In addition, an antenna device 226 (see FIG. 3) for implementing wireless communication may be disposed within the terminal body.

Those antennas may be combined with each other to form an antenna device which provides various integrated communication services. To this end, the antenna device may be provided with antenna patterns for transmitting and receiving wireless signals.

Also, in order to dispose a plurality of antennas within a portable terminal, a spaced distance between adjacent antennas may be shortened. However, when the spaced distance between the antennas becomes short, interference may be to caused due to electromagnetic waves emitted from each antenna. To prevent the problem, antennas may be electrically connected using a metal member made of a conductive material. The metal member may induce a current element which interferes with a feed point of each antenna, thereby improving an isolation of each antenna. Also, the present disclosure may dispose the metal member along is an edge of at least one of the front surface, the rear surface and the side surface of the terminal body, to prevent the internal structure of the terminal from being complicated due to the metal member.

Figure 3:
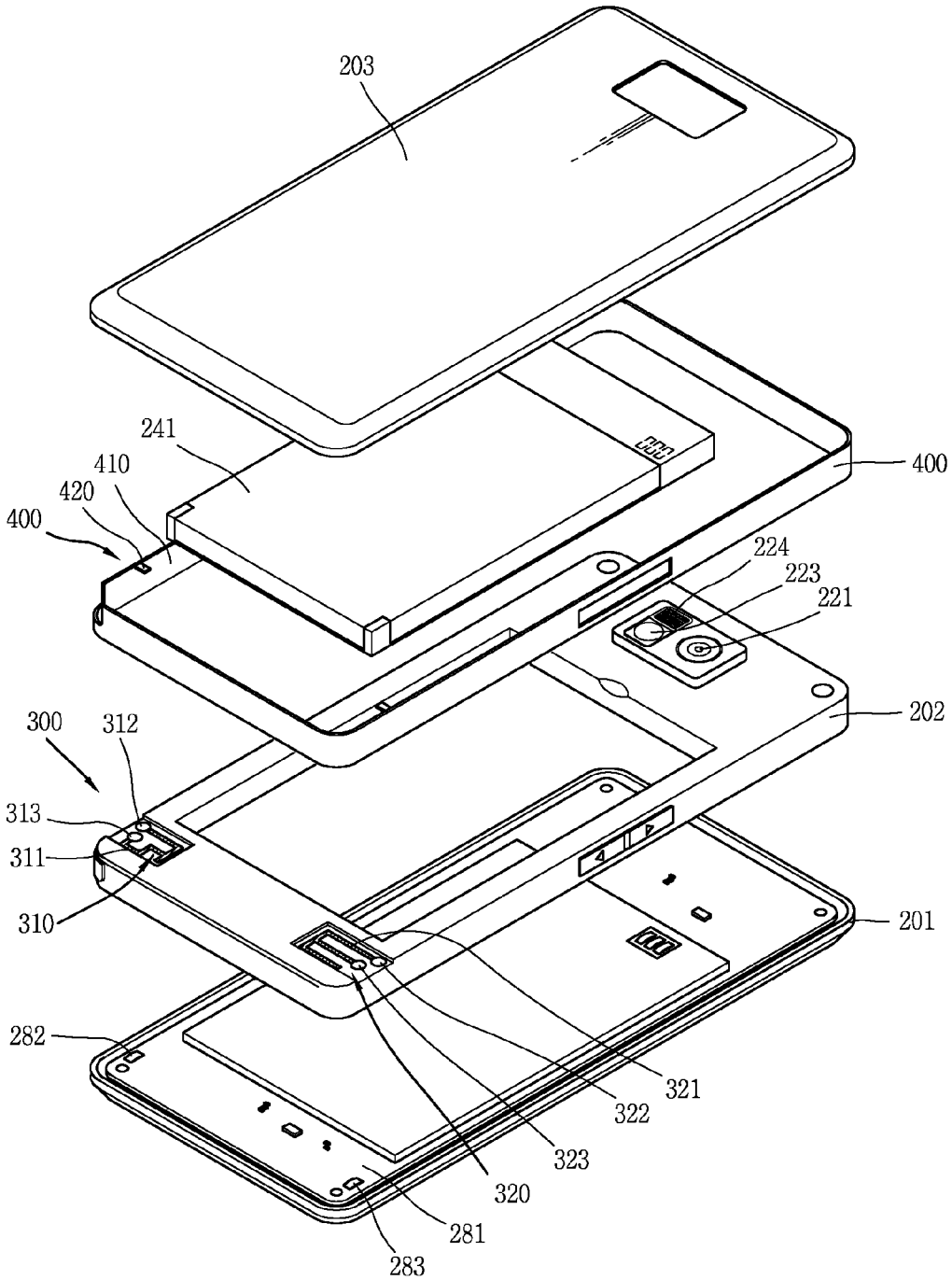
FIG. 3 is a disassembled view of the portable terminal of FIG. 2B.

Hereinafter, description will be given of a structure of electrically connecting the antennas. FIG. 3 is a disassembled view of the portable terminal of FIG. 2B, and FIG. 4 is a conceptual view showing a method of connecting antennas shown in FIG. 3.

As shown in FIG. 3, an external appearance of the terminal body may be defined by coupling of the side case 202, the front case 201 and the rear case 203.

A display module (not shown) may be mounted onto one surface of the front case 201. The display module may include a window and a display unit 210 (see FIG. 2A), and be sensitive to touch.

Figure 4:
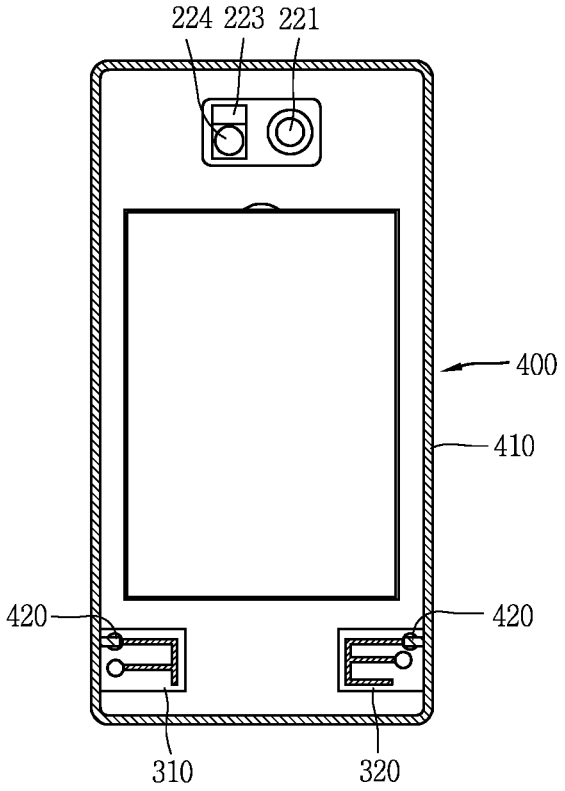
FIG. 4 is a conceptual view showing a method for connecting antennas shown in FIG. 3.

Referring to FIGS. 3 and 4, a printed circuit board 281 for control of the display module may be mounted within the terminal body. The printed circuit board 281, for example, may be mounted onto the front case 201, the side case 202 or the rear case 203, or on a separate internal structure. Hereinafter, description will be given of an example that the front case 201, the side case 202 or the rear case 203 is separately formed. However, the present disclosure may not be limited to the structure, but some of the cases 201, 202 and 203 may be integrally formed with each other.

The printed circuit board 281 may be configured as one example of the controller 180 (see FIG. 1) for operating various functions of the portable terminal. The printed circuit board 281 may be provided in plurality to execute functions of the controller 180 by combination thereof.

Meanwhile, various electronic devices may be mounted onto one surface is of the printed circuit board 281. A supporting member 282 for protection of the electronic devices may be mounted on the one surface. The supporting member 282 may be a metal plate.

Also, as shown, a battery as one example of a power supply unit may be mounted within the terminal. The battery may be interposed between a rear surface of the side case 202 and the rear case 203.

A plurality of antennas 300 may be disposed on one end portion of the side case 202. The antennas 300 may be electrically connected to the printed circuit board 281. The printed circuit board 281 may process wireless signals corresponding to wireless electromagnetic waves received by the antennas 300. The antennas 300 may transmit or receive the wireless signals via the rear case 203. The antennas 300 may be provided in plurality on at least one end portion of the side case 202, in addition to those shown in the drawings.

As such, the antenna provided in plurality may be one of an antenna which is formed to transmit or receive a wireless signal corresponding to at least one of personal communication system (PCS), advanced wireless service (AWS), digital communication network (DCN) and long term evolution (LTE), a broadcast signal receiving antenna which operates at an FM radio frequency band, a Bluetooth or WiFi band, a Bluetooth antenna, a satellite signal receiving antenna, and a data receiving antenna of a wireless Internet Hereinafter, a first antenna 310 of the plurality of antennas 300 will be exemplarily described. The first antenna 310 may include a radiation part 311, a feed part 312 and a ground part 313. The radiation part 311 may be made of a conductive metal strip, and patterned to resonate at a first frequency band, namely, one frequency band. For example, the radiation part 311 may be patterned such that the first frequency band can be 1.2 GHz band. That is, the radiation part 311 may be formed as a single pattern. For example, the first antenna 311 may be implemented as an inverted-F antenna or an inverted-L antenna.

Also, the feed part 312 and the ground part 313 may extend from the radiation part 311 and contact a connection unit 400 formed on the printed circuit board 281. The feed part 312 and the ground part 313 may be spaced apart from each other at one region of the radiation part 311 to which the feed part 312 and the ground part 313 are connected.

The feed part 312 may feed a signal transferred from the printed circuit board 281 into the radiation part 311 to feed the first antenna 310. The description of the first antenna may commonly be applied to other antennas mounted in the portable terminal according to the present disclosure. As shown, a second antenna 320 may also include a radiation part 321, a feed part 322 and the ground part 323.

Meanwhile, in the portable terminal, the first and second antennas 310 and 320, which are disposed adjacent to each other to transmit or receive wireless signals of different frequency bands, may be electrically connected to each other via a connection unit 400 formed along an edge of the terminal body.

The connection unit 400, as shown in FIG. 3, may be partially exposed to the outside to form a loop along an edge of a side surface of the terminal body, namely, the edge of the side case 202. Although not shown, at least part of the connection unit 400 may be formed along the edge of the side surface of the terminal body or located within the terminal body.

The connection unit 400 may also be formed along the rear surface of the terminal body and at least part of the connection unit may be formed along an is edge of the rear case 203.

The connection unit 400, as shown, may be implemented such that at least part thereof can protrude into the terminal body so as to be connected to at least part of each of the first and second antenna 310 and 320 in a one-to-one correspondence.

Referring to FIG. 4, the connection unit 400 may be formed along the side surface of the terminal body, and include a first connection portion 410 made of a conductive material. The connection unit 400 may also include a second connection portion 420 disposed between the first connection portion 410 and each of the first and second antennas 310 and 320, and made of the conductive material such that the first and second antennas 310 and 320 can be electrically connected to the first connection portion 410.

Here, the first and second connection portions 410 and 420 may be formed integrally or separately. The second connection portion 420 may be implemented as a metal member, a cable or a flexible printed circuit board made of a conductive material.

The materials for forming the first and second connection portions 410 and 420 may depend on whether or not the connection unit 400 is exposed to the outside of the terminal body.

As one example, when at least part of the connection unit 400, as shown in FIG. 3, is exposed to the outside of the terminal body with surrounding the edge of the rear case 202, the externally exposed portion of the connection unit 400 may correspond to a metal member (corresponding to the first connection portion 410, see FIG. 4) made of the conductive material, namely, a metallic decoration.

The connection unit 400 implemented as the metal member may include extending portions 420*a* and 420*b* (corresponding to the second connection portion 420, see FIG. 4), which extend into the terminal body to be connected to the first and second antennas 310 and 320, respectively. As one example, the extending portions 420*a* and 420*b*, as shown, may be formed integrally with the metal member.

Meanwhile, as one example, the connection unit 400 may be electrically connected to portions adjacent to the feed part 312 of the first antenna 310 and the feed part 322 of the second antenna 320, respectively.

Although not shown, as another example, the connection unit 400 may be connected to the ground part 313 on which the first antenna 310 is connected to a ground, and the ground part 323 on which the second antenna 320 is connected to the ground.

As another example, at least part of the connection unit 400 may be connected to a portion adjacent to the feed part 312, which is connected to the printed circuit board 281 (see FIG. 3) for processing a wireless signal of the first antenna 310, or a portion adjacent to the ground part 313 of the first antenna 310, and a portion adjacent to the feed part 322 which is connected to the printed circuit board 281 (see FIG. 3) for processing a wireless signal of the second antenna 320, or a portion adjacent to the ground part 323 of the second antenna 320.

The connection unit 400 may be connected to the portions adjacent to the feed parts 312 and 322 or the ground parts 313 and 323 of the first and second antennas 310 and 320, namely, portions on which a large current flows on the antennas, so as to induce a current element, which causes an interference between adjacent antennas, to flow toward the connection unit 400.

Therefore, in the portable terminal according to the present disclosure, a current element which interferes with the feed parts of the adjacent antennas may be offset by the connection part 400, resulting in improvement of an isolation of each of the plurality of antennas.

Figure 5A:
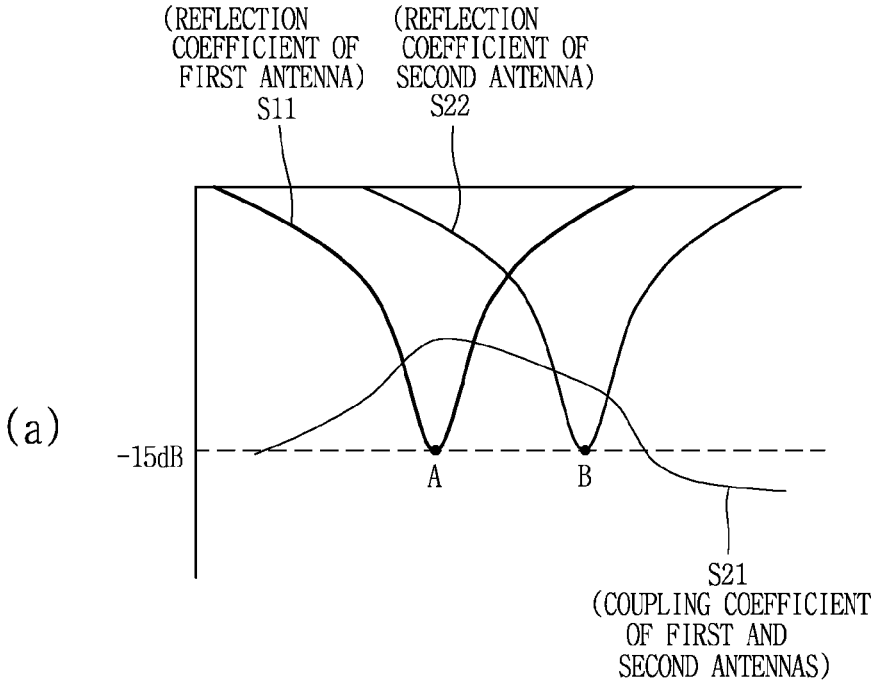
FIGS. 5A and 5B are conceptual views showing characteristics of the antennas when the antennas are electrically connected as shown in FIG. 4.
Figure 5A:
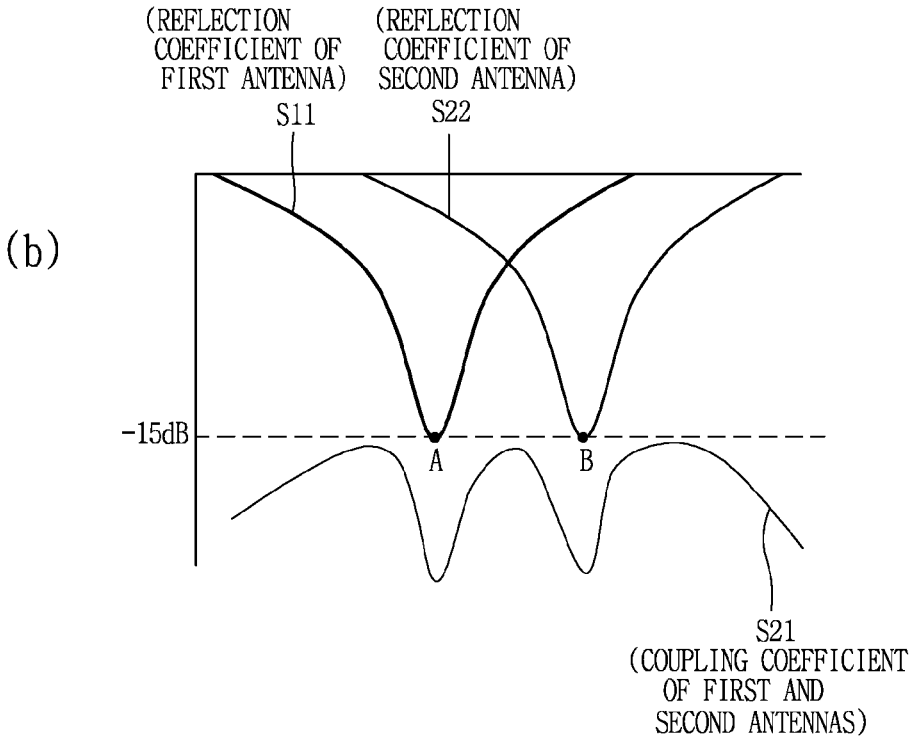
Figure 5B:
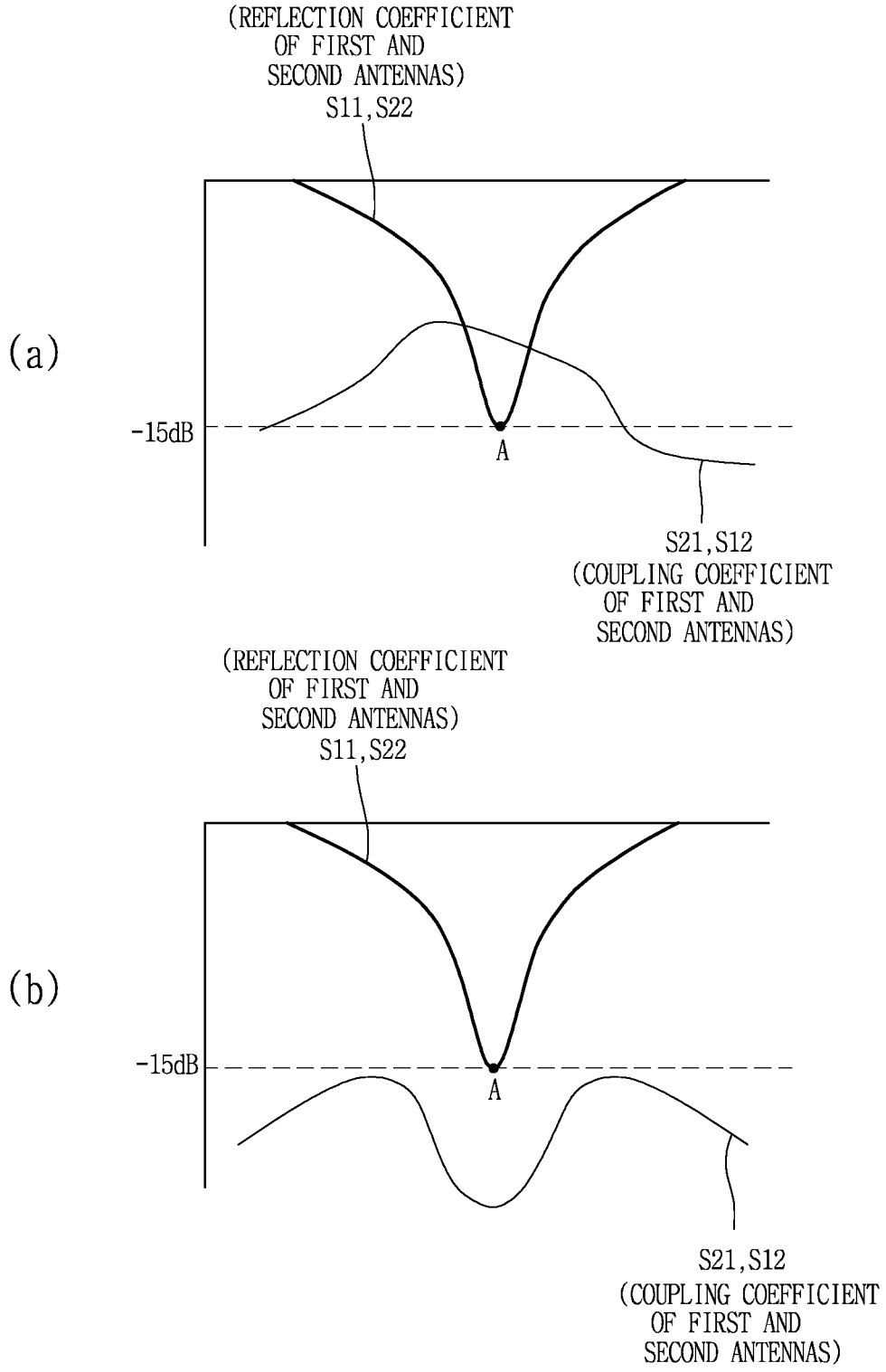

Hereinafter, description will be given of improved characteristics of antennas when the antennas are electrically connected as aforementioned. FIGS. 5A and 5B are conceptual views showing characteristics of the antennas when the antennas are electrically connected as shown in FIG. 4.

First, a horizontal axis in FIGS. 5A and 5B indicates a frequency band, and a vertical axis indicates magnitudes of a reflection coefficient and a coupling coefficient.

Here, the reflection coefficient is a parameter which indicates a level that power desired to be transmitted via an antenna partially comes back without being radiated. When the reflection coefficient is low, a radiation performance of an antenna is excellent.

Also, the coupling coefficient is a parameter which indicates a level that a signal radiated from one antenna is input into another antenna. When the coupling coefficient is low, interference between antennas is low. As antennas resonate, mutual inductance is formed between at least two antennas due to generation of a magnetic flux by a resonant current. The mutual inductance causes the adjacent antennas to electrically interfere with each other. A value indicating the level of the interference is the coupling coefficient.

A graph (A) of FIG. 5A conceptually shows a coupling coefficient prior to electrically connecting the first and second antennas 310 and 320 (see FIG. 3) using the connection unit 400 (see FIG. 3), and a graph (B) of FIG. 5A conceptually shows a coupling coefficient after electrically connecting the first and second antennas 310 and 320 using the connection unit 400.

As shown in the graphs (A) and (B) of FIG. 5A, the first antenna 310 may transmit or receive a wireless signal at a frequency band 'A' and the second antenna 320 may transmit or receive a wireless signal at a frequency band 'B.'

Also, as shown in the graph (A) of FIG. 5A, it can be understood that the coupling coefficient prior to electrically connecting the first and second antennas 310 and 320 to each other is relatively high at the frequency bands 'A' and 'B' at which the first and second antennas 310 and 320 transmit or receive the wireless signals, respectively. Here, when the first antenna 310 transmits a wireless signal at the frequency band 'A,' power that the first antenna 310 desires to transmit may partially be input into the second antenna 320 due to the interference by the second antenna 320, thereby lowering the performance of the first antenna 310.

Similarly, when the second antenna 320 disposed adjacent to the first antenna 310 transmits a wireless signal at the frequency band 'B,' power that the second antenna 320 desires to transmit may partially be input into the first antenna 310, thereby lowering the performance of the second antenna 320.

In the meantime, as shown in the graph (B) of FIG. 5A, it can be understood that the coupling coefficient after electrically connecting the first and second antennas 310 and 320 to each other is low at the frequency bands 'A' and 'B' at which the first and second antennas 310 and 320 transmit or receive the wireless signals, respectively.

Here, even if the first antenna 320 is disposed adjacent to the second antenna 320, as shown in the graph, the first antenna 310 may remain isolated from the second antenna 320 at the frequency band 'A' at which the first antenna 310 transmits the wireless signal.

Similarly, even if the second antenna 320 is adjacent to the first antenna 310, the second antenna 320 may remain isolated from the first antenna 310 at the frequency band 'B' at which the second antenna 320 transmits the wireless signal.

Hereinafter, the coupling coefficient between antennas operating at the similar or same frequency band will be described.

A graph (A) of FIG. 5B conceptually shows a coupling coefficient prior to electrically connecting the first and second antennas 310 and 320 (see FIG. 3) using the connection unit 400 (see FIG. 3), and a graph (B) of FIG. 5B conceptually shows a coupling coefficient after electrically connecting the first and second antennas 310 and 320 using the connection unit 400.

As shown in the graphs (A) and (B) of FIG. 5B, the first antenna 310 and the second antenna 320 may transmit or receive a wireless signal at a frequency band 'A.'

Also, as shown in the graph (A) of FIG. 5B, it can be understood that the coupling coefficient prior to electrically connecting the first and second antennas 310 and 320 to each other is relatively high at the frequency band 'A' at which the first and second antennas 310 and 320 transmit or receive the wireless signals. Here, when the first antenna 310 transmits a wireless signal at the frequency band 'A,' power that the first antenna 310 desires to transmit may partially be input into the second antenna 320, thereby lowering the performance of the first antenna 310.

Similarly, when the second antenna 320 disposed adjacent to the first antenna 310 transmits a wireless signal at the frequency band 'A,' power that the second, antenna 320 desires to transmit may partially be input into the first antenna 310, thereby lowering the performance of the second antenna 320.

In the meantime, as shown in the graph (B) of FIG. 5B, it can be understood that the coupling coefficient after electrically connecting the first and second antennas 310 and 320 to each other is low at the frequency band 'A' at which the first and second antennas 310 and 320 transmit or receive the wireless signals.

Here, even if the first antenna 320 is disposed adjacent to the second antenna 320, as shown in the graph, the first antenna 310 and the second antenna 320 may remain isolated from each other at the frequency band 'A' at which the first and second antennas 310 and 320 transmit the wireless signal, As described above, in the portable terminal according to the present disclosure, the antennas adjacent to each other may be electrically connected to each other, thereby reducing frequency interference between the antennas.

Hereinafter, description will be given in more detail of a method for disposing a connection unit for electrical connection of a plurality of antennas. FIGS. 6A to 6F are process views showing a method for disposing a connection unit for electrically connecting the antennas according to the present disclosure.

Figure 6A:
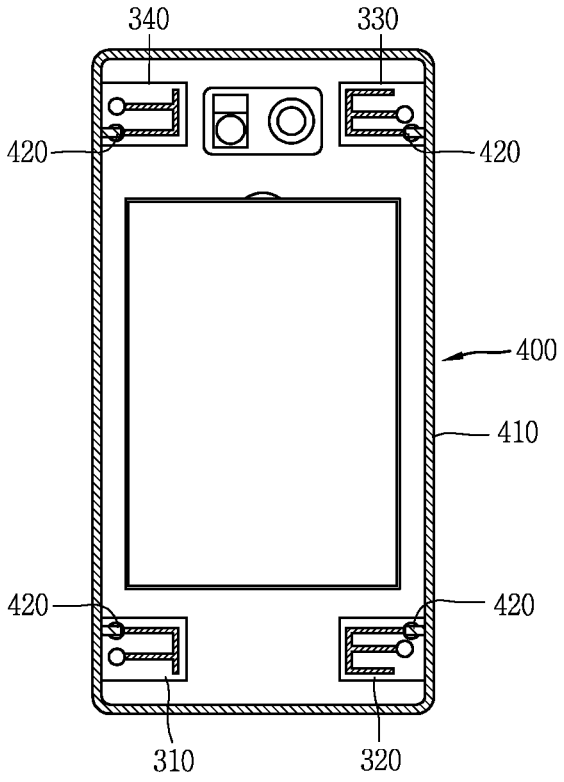
FIGS. 6A to 6F are process views showing a method for arranging a connection unit for electrically connecting the antennas according to the present disclosure.
Figure 6B:
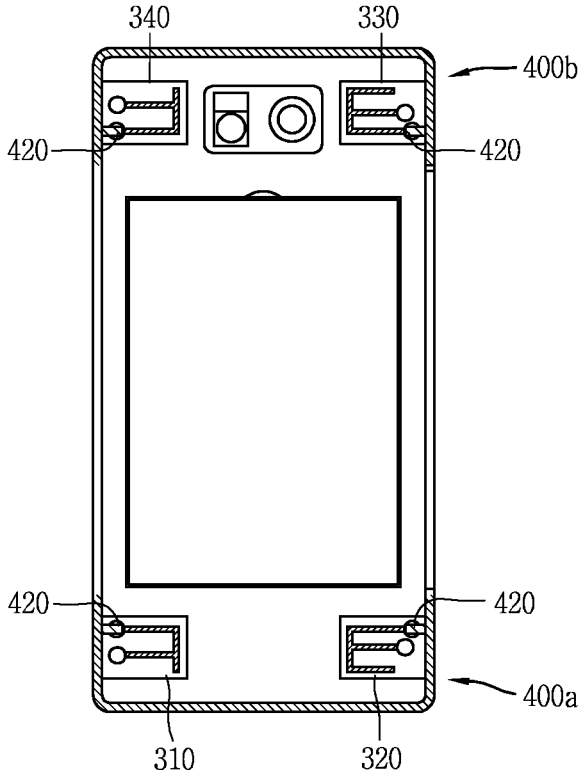

First, FIGS. 6A and 6B are planar views showing a removed state of the rear case 203 (see FIG. 3) of the portable terminal shown in FIG. 2B.

As shown in FIGS. 6A and 6B, the connection unit 400 for electrically connecting at least two antennas to each other may be formed such that at least part thereof can be exposed along the appearance of the terminal body. The connection unit 400 may be implemented as a metal member made of a conductive material, thereby inducing a current element, which causes is interference between the plurality of antennas connected via the connection unit 400, to flow toward it.

The at least part of the connection unit exposed to the appearance of the terminal body will be described in more detail. Referring to FIG. 6A, at least part of the connection unit 400 may form a loop along a side surface of the terminal body. Here, the connection unit 400 may be formed to be as thick as the side surface of the terminal body as shown in FIG. 3, or be thinner than the thickness of the side surface of the terminal body to enclose the side surface.

Also, the connection unit 400 may be curved from one side of the side surface of the terminal body toward another side perpendicular to the one side. For example, the connection unit 400 may be curved from one side at which the first and second antennas 310 and 320 are disposed toward a third antenna 330 such that the first antenna 310 and the third antenna 330 can be electrically connected to each other. The connection unit 400 may extend from the third antenna 330 toward one side at which a fourth antenna 340 is disposed such that the third antenna 330 can be electrically connected to the fourth antenna 340. According to this method, the connection unit 400 may extend to surround every edge of the side surface of the terminal body, starting from one point, thereby forming a closed loop. Here, the first to fourth antennas 310, 320, 330 and 340 may all be electrically connected by the connection unit 400.

That is, the connection unit may be implemented as a metal member made of a conductive material, so as to be exposed to the outside of at least one of the front surface, the side surface and the rear surface of the terminal body. Here, the connection unit implemented as the metal member may provide a different type of texture from a window disposed on the front surface of the is terminal body, thereby decorating the appearance of the terminal body and stabilizing the antennas mounted in the terminal body.

In the meantime, the metal member may further include an extending portion extending into the terminal body to be connected to each of the antennas. Here, the extending portion may correspond to the second connection portion 420 shown in FIGS. 3 and 4.

As such, in the portable terminal according to the present disclosure, the connection unit having the extending portion may allow for electrical connection of the plurality of antennas, so as to induce the current element, which causes the interference between the plurality of antennas, to flow toward it. The connection unit, especially the extending portion for electrically connecting the plurality of antennas may be named a neutralization line, a decoupling line or a phase shift line.

Referring to FIG. 6B, the connection unit 400 may be formed to surround at least part of the side surface of the terminal body. Here, the connection unit 400 as the metal member may form a part of an edge of the terminal. That is, the connection unit 400 may be formed only on portions, corresponding to positions where antennas are disposed, of the outer appearance of the terminal body.

For example, a first connection portion 400*a* may be formed only on a portion corresponding to one side of the side surface of the terminal body such that the first and second antennas 310 and 320 disposed along the one side with a spaced distance therebetween can be electrically connected to each other. Also, a connection portion 400*b* may be formed only on a portion corresponding to another side of the side surface of the terminal body, different from the one side, such that the third and fourth antennas 330 and 340 disposed along the another side with a spaced distance therebetween can be electrically connected to each other.

Each of the first and second connection portions 400*a* and 400*b* may further include extending portions 420 extending into the terminal body to be connected to the respective antennas. Here, the extending portion may correspond to the second connection portion 420 shown in FIGS. 3 and 4.

As such, in the portable terminal according to the present disclosure, the connection unit and the extending portion may offset the current element which interferes with the feed parts of the adjacent antennas, thereby improving an isolation of each of the plurality of antennas. The extending portions which electrically connect the connection unit implemented as the metal member to the plurality of antennas may be named a neutralization line, a decoupling line or a phase shift line.

Figure 6C:
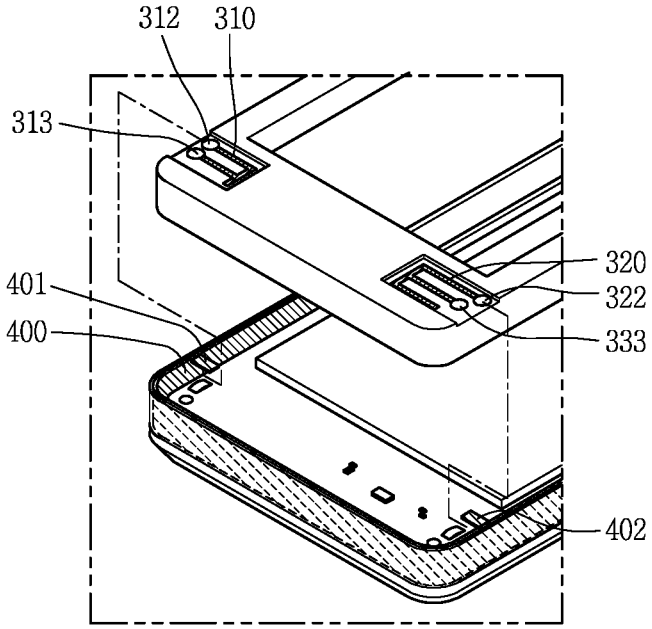

Next, referring to FIG. 6C, the connection unit 400 may form a metal layer along an inner surface of the side surface of the terminal body. The metal layer may form a closed loop along the edge of the side surface of the terminal as shown in FIGS. 6A and 6B, or be partially formed only on sides where antennas are disposed.

Also, the metal layer may be implemented as a metal plate or a metal sheet, or by directly plating one surface of a case surrounding the terminal body.

Also, at least part of the connection unit 400 may extend into the terminal (see 401 and 402 of FIG. 6C) to be connected to the feed part 312 or the ground part 313 of the first antenna 310 and connected to the feed part 322 or the ground part 323 of the second antenna 320.

As such, in the portable terminal according to the present disclosure, the plurality of antennas may be electrically connected via the connection unit, namely, the metal layer, effectively reducing the coupling coefficient between the antennas. The connection unit for electrically connecting the plurality of antennas may be named a neutralization line, a decoupling line or a phase shift line.

Figure 6D:
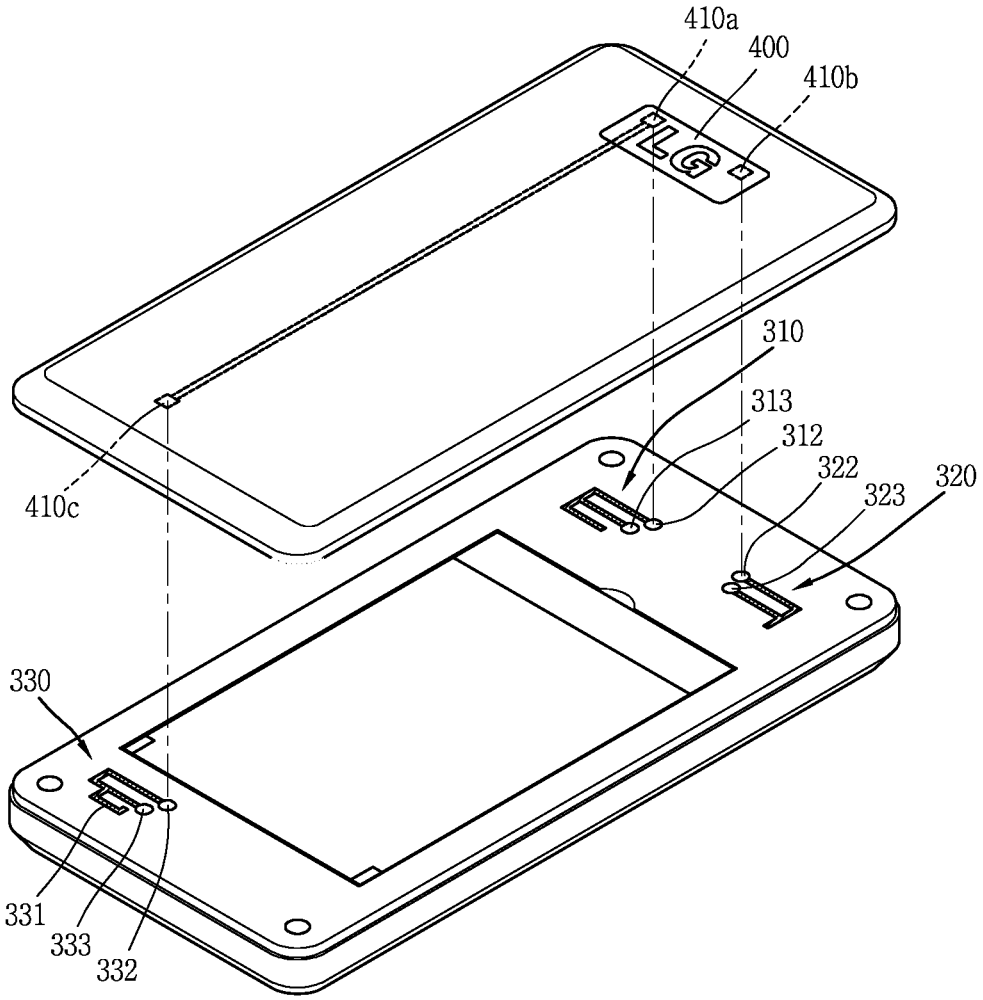

Referring to FIG. 6D, the connection unit may be implemented using a logo which is exposed to at least one of the front surface and the rear surface of the terminal body.

As shown, the connection unit 400, namely, at least part of the logo may extend into the terminal body to be electrically connected to the first and second antennas 310 and 320 at both ends of the extended at least part of the logo.

Extending portions 410*a* and 410*b* may protrude from the logo at positions corresponding to the feed parts 312 and 322 or the ground parts 313 and 323 of the first and second antennas 310 and 320 such that the both ends of the connection unit 400 (or logo) can be connected only to portions adjacent to the feed parts 312 and 322 or the ground parts 313 and 323. The extending portions 410*a* and 410*b* may be made of a conductive material for allowing the electrical connection between the connection unit 400 (or logo) and the antennas.

In the meantime, at least part of the connection unit 400 may extend up to a feed part 332 or a ground part 333 of a third antenna 330, which is disposed on a side different from a side having the first and second antennas 310 and 320, such that the third antenna 330 can be electrically connected to at least one of the first and second antennas 310 and 320.

As such, in the portable terminal according to the present disclosure, the connection unit (or the metal logo) and the extending portion may be used to electrically connect the plurality of antennas, so as to offset the current element which interferes with the feed parts of the adjacent antennas, thereby improving an isolation of each of the plurality of antennas. Here, the extending portion for electrically connecting the connection unit to the plurality of antennas may be named a neutralization line, a decoupling line or a phase shift line for offsetting the frequency interference between the plurality of antennas.

Figure 6E:
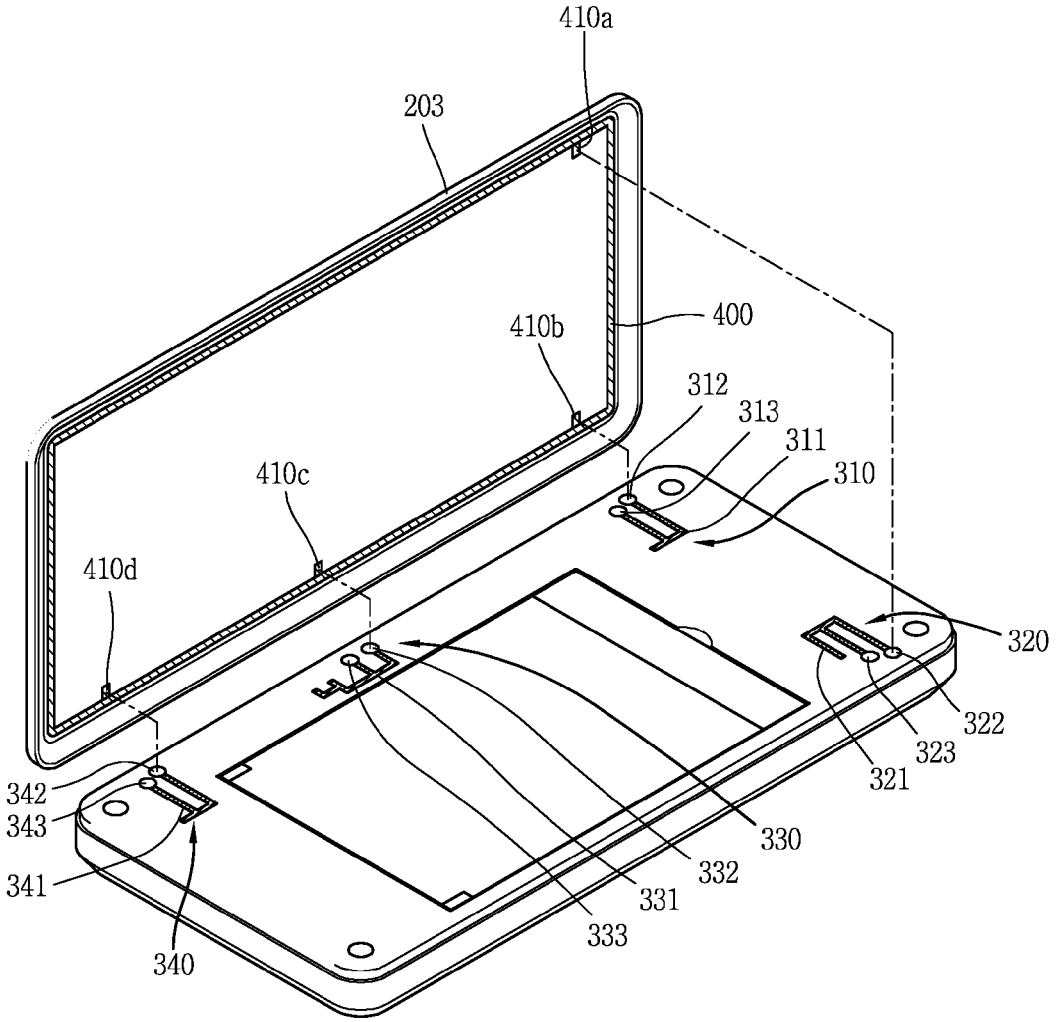

Referring to FIG. 6E, the connection unit may form a metal layer along an inner surface of the rear case 203 which covers the rear surface of the terminal body. The metal layer may form a closed loop along the edge of the rear case 203 as shown in FIGS. 6A and 6B, or be partially formed only on sides where antennas are disposed.

The metal layer may also be implemented as a metal plate and a metal sheet, or by plating one edge of the rear case 203 surrounding the terminal body.

Also, the connection unit 400 may extend toward positions, on which the feed parts or the ground parts of the plurality of antennas, for example, the first to fourth antennas 310, 320, 330 and 340, are disposed, so as to be electrically connected to the plurality of antennas (see 410*a*, 410*b*, 410*c* and 410*d*).

As such, in the portable terminal according to the present disclosure, the metal layer formed on the rear surface of the terminal body may be employed to electrically connect the plurality of antennas. This may offset the current element interfering with the feed parts of the antennas disposed adjacent to each other, thereby improving an isolation of each of the plurality of antennas. Here, the connection unit, namely, the metal layer for electrically connecting the plurality of antennas may be named a neutralization line, a decoupling line or a phase shift line for offsetting the frequency interference between the plurality of antennas.

Also, as shown in FIGS. 6A to 6E, the connection unit for electrically connecting the different antennas may be configured such that one of portions adjacent to the feed part and the ground part of one antenna can be connected to another antenna.

Figure 6F:
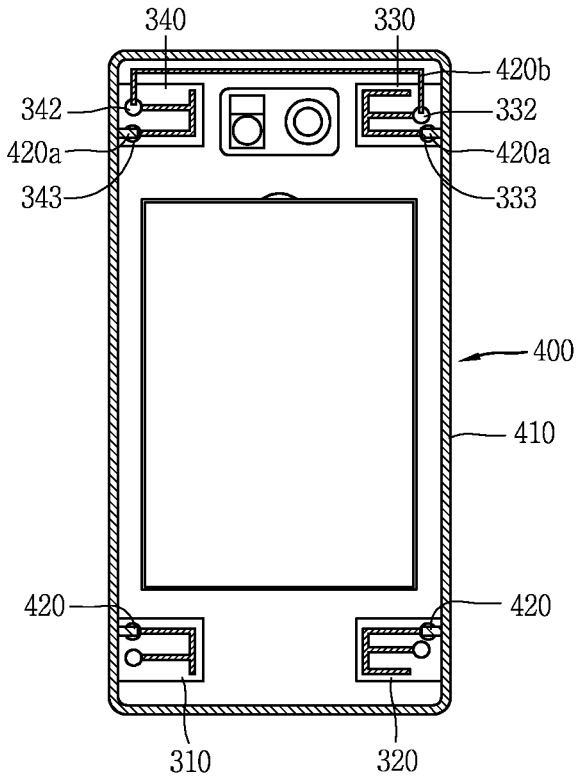

In addition, the connection unit, as shown in FIG. 6F, may be provided with plurality of connection portions. Here, first connection portions 420*a* and a second connection portion 420*b* may electrically connect a plurality of portions of the first antenna 310 to the second antenna 320, respectively.

Similarly, the first and second connection portions 420*a* and 420*b* may electrically connect a plurality of portions of the second antenna 320 to the first antenna 310, respectively.

Here, the feed part 312 of the first antenna 310 may be connected to the feed part 322 or the ground part 323 of the second antenna 320 and the ground part 313 of the first antenna 310 may be connected to the feed part 321 or the ground part 323 of the second antenna 320, via the first and second connection portions 420*a* and 420*b*.

Meanwhile, the plurality of connection portions may be implemented as a metal member made of a conductive material so as to be exposed to the outside of at least one of the front surface, the side surface and the rear surface of the terminal body. Here, the connection unit implemented as the metal member may provide a different type of texture from a window disposed on the front surface of the terminal body, thereby decorating the appearance of the terminal body and stabilizing the antennas mounted in the terminal body. Here, the metal member may further include an extending portion extending into the terminal body to be connected to the antennas, respectively. Here, the extending portion may correspond to the second connection portion 420 shown in FIGS. 3 and 4.

Also, at least one of the plurality of connection portions may be formed within the terminal body to electrically connect the plurality of antennas.

As described above, in the portable terminal according to the present disclosure, the connection unit for electrically connecting the plurality of antennas may be exposed to the outside of the terminal, thereby decorating the appearance of the terminal body and stabilizing the antennas mounted in the terminal body.

Also, as the connection unit is formed along the inner surface of the edge of the terminal body, a separate device which occupies a predetermined space within the terminal for preventing the frequency interference between the antennas may not be required.

Figure 7A:
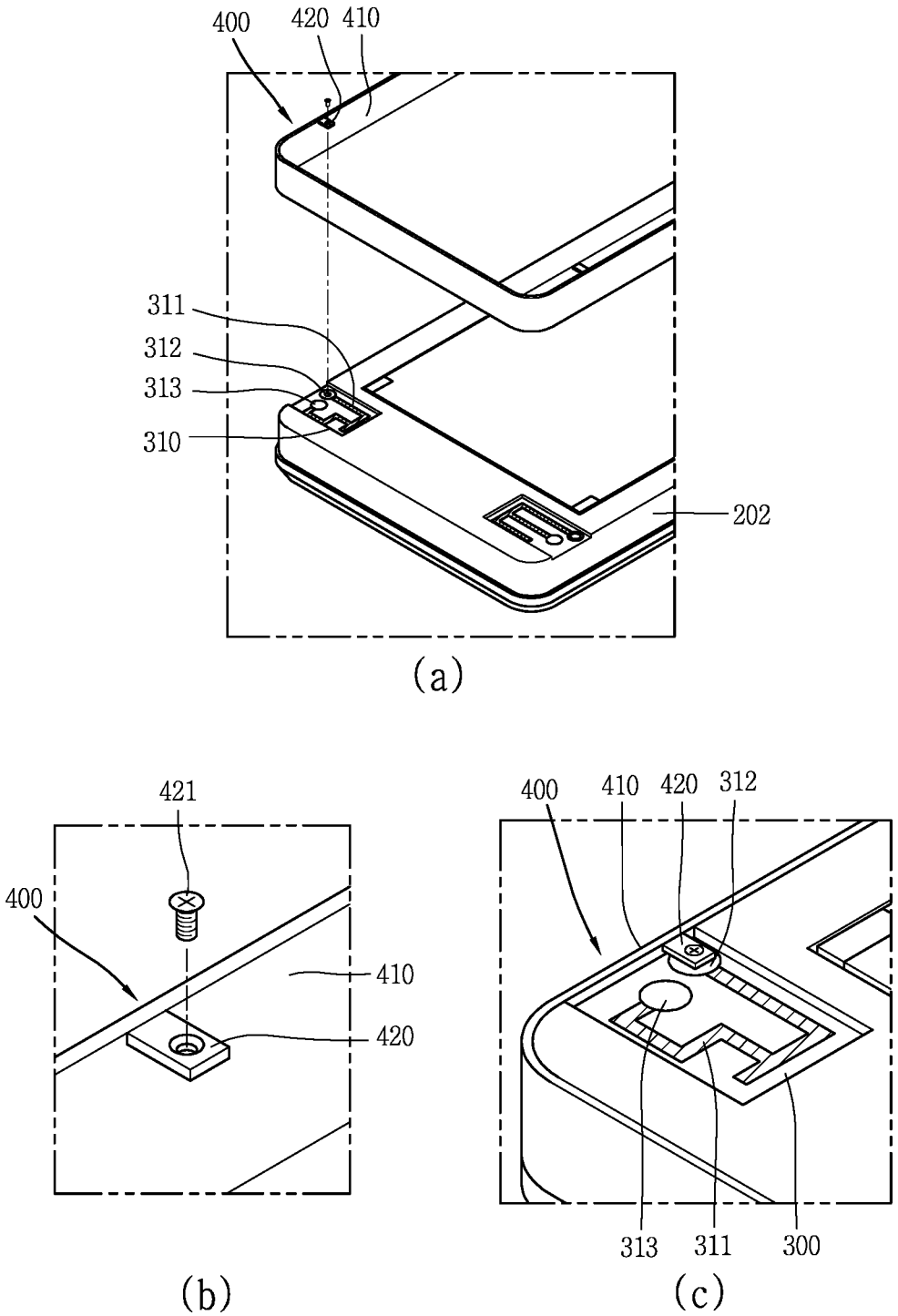
FIGS. 7A to 7C are process views showing a connection relation between the antennas and the connection unit.
Figure 7B:
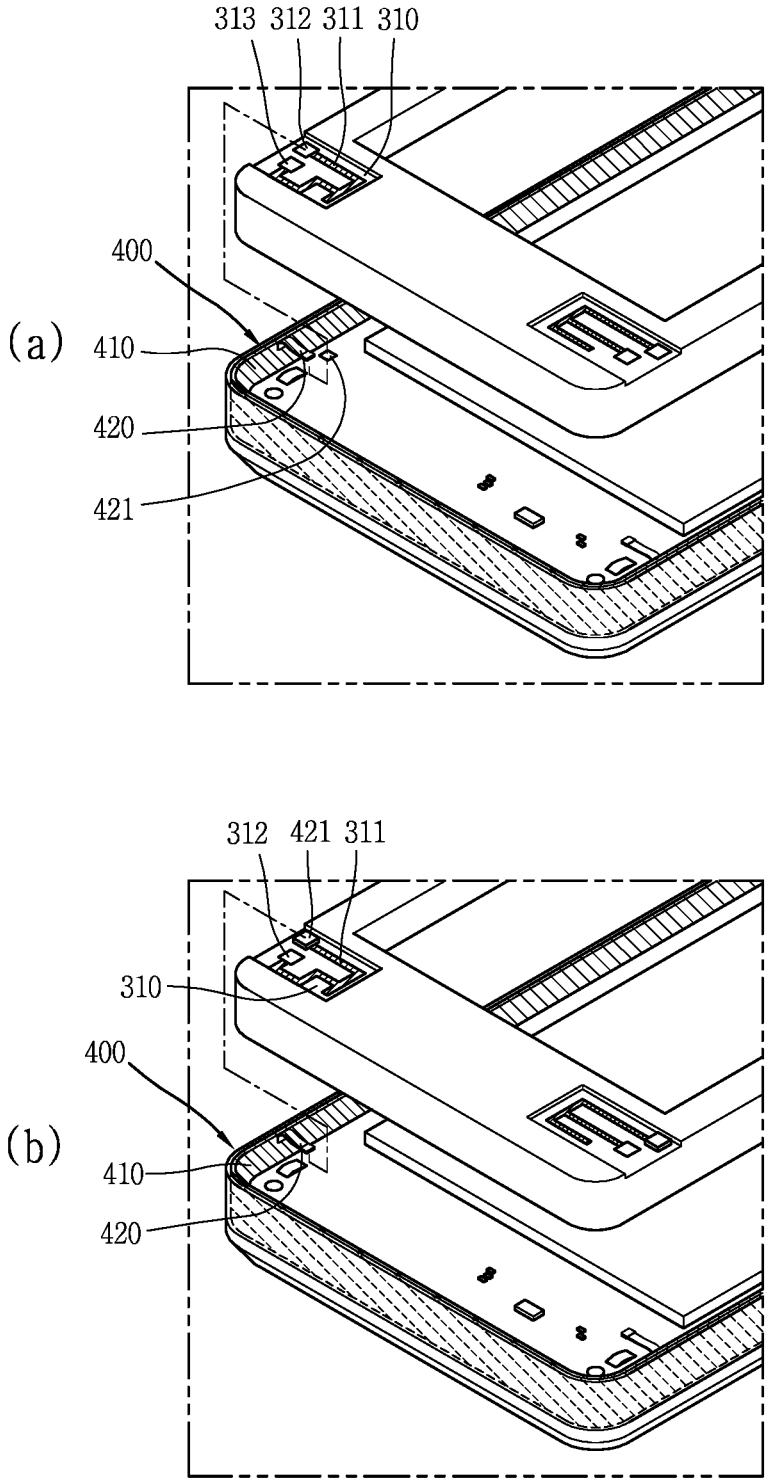
Figure 7C:
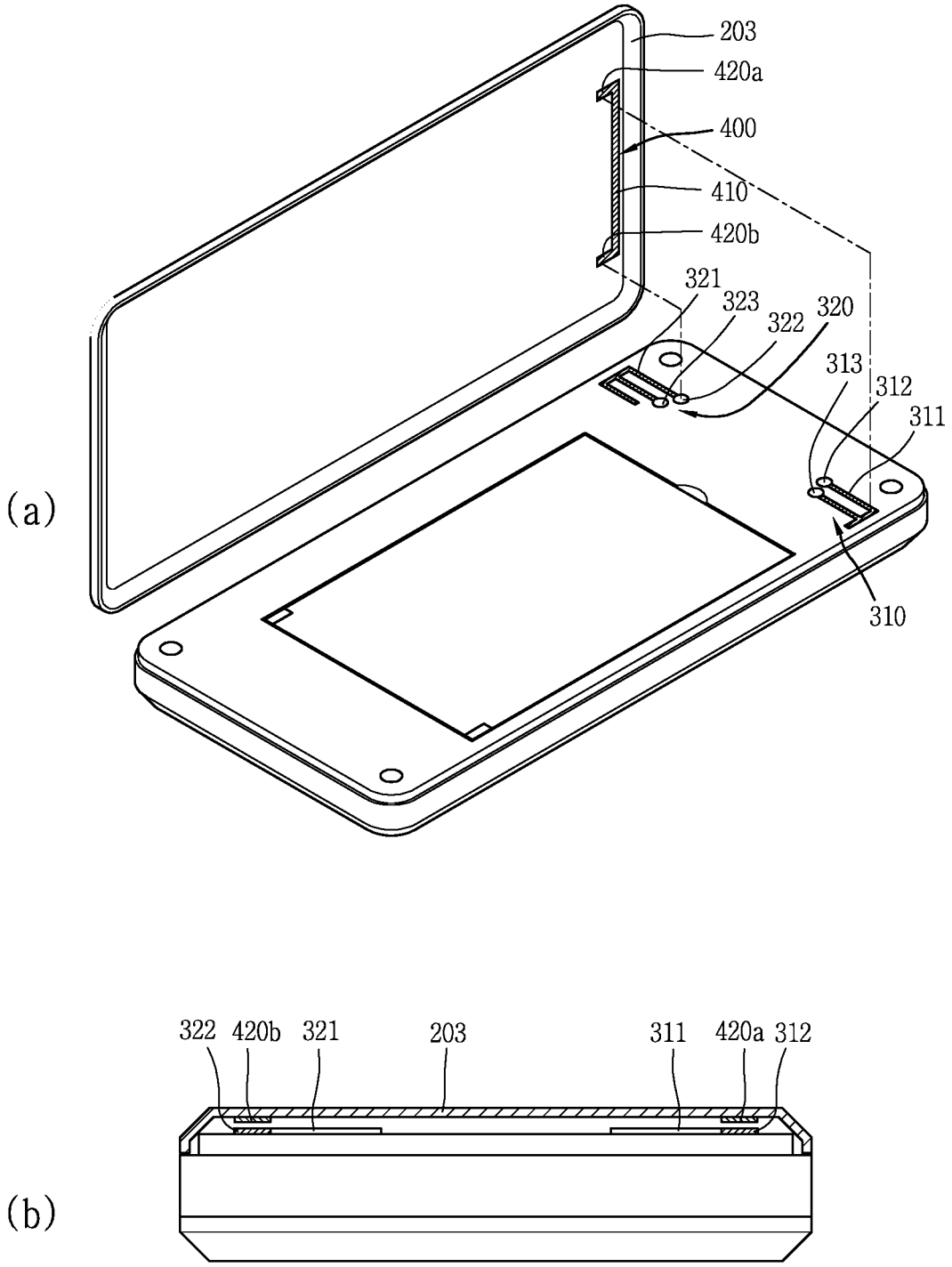

Hereinafter, various examples of connecting (coupling) the connection unit to antennas will be described in more detail. FIGS. 7A to 7C are process views showing a connection relation between the antennas and the connection unit.

The connection unit and the antennas may be electrically connected by various methods. As one example, a metal plate extending from the connection unit may be coupled to at least part of an antenna by a screw. Also, as another example, the connection unit may be coupled to at least part of an antenna using a cable or a flexible printed circuit board which extends from at least part of the connection unit into the terminal body. As another example, a connection unit made of a metal and an antenna may be disposed at adjacent positions to each to other such that the connection unit can be coupled to at least part of the antenna, thereby electrically connecting the connection unit to the antenna.

Hereinafter, the examples will be described in more detail.

First, referring to FIG. 7A, an example that the connection unit 400 is coupled to the ground part 312 of the first antenna 310 via a metal plate will be is described.

As shown in (A) of FIG. 7A, the connection unit 400 may include a first connection portion 410 exposed to the outside of the terminal body to surround the side case 202 of the terminal body, and a second connection portion 420 extending from the first connection portion 410 into the terminal body.

Here, the first connection portion 410 may be made of a conductive material in order to be electrically connected to the antenna 310. The second connection portion 420 may be implemented as a metal plate made of a conductive material in order to electrically connect the first connection portion 410 to at least part of the antenna 310.

Also, the second connection portion 420 may be formed integrally with the first connection portion 410. The second connection portion 420 may protrude from at least part of the first connection portion 410 into the terminal body to elastically contact a portion adjacent to the feed part 312 or the ground part 313 of the first antenna 310.

As shown in (B) and (C) of FIG. 7A, to fix the coupling between the second connection portion 420 and the antenna 310, the second connection portion 420 and at least part of the antenna 310 may be coupled by using a screw 421.

As such, the second connection portion 420 for electrically connecting the first connection portion 410 to the antennas may be named a neutralization line, a decoupling line or a phase shift line for offsetting the frequency interference between the plurality of antennas.

Next, referring to (A) of FIG. 7B, the connection unit 400 and the antenna 310 may be connected to each other via a cable or a flexible printed circuit board.

As shown in (A) of FIG. 7B, the connection unit 400 may include a first connection portion 410 formed along one surface within the terminal body to electrically connect a plurality of antennas, and a second connection portion 420 extending from the first connection portion 410 into the terminal body.

Here, the first connection portion 410 may be made of a conductive material in order to be electrically connected to the antenna 310. The first connection portion 410 may be implemented as a metal layer along an inner surface of the side surface of the terminal body. Also, the second connection portion 420 may be implemented as a cable or a flexible printed circuit board made of a conductive material in order to electrically connect the first connection portion 410 to at least part of the antenna 310. As such, the connection portion 420 implemented as the cable or the flexible printed circuit board may be named a neutralization line, a decoupling line or a phase shift line for offsetting the frequency interference between the plurality of antennas.

Referring to (A) and (B) of FIG. 7B, for smooth coupling between the second connection portion 420 and the antenna 310, a pad 421 having conductivity may be used to couple the second connection portion 420 to the feed part 312 or the ground part 313 of the antenna 310.

Referring to FIG. 7C, the connection unit 400 made of a metal may be electrically coupled to an antenna.

As shown in (A) of FIG. 7C, the connection unit 400 may include a first to connection portion 410 disposed along at least one edge of an inner surface of the rear case 203, and second connection portions 420*a* and 420*b* extending from the first connection portion 410 to electrically connect the first connection portion 410 to first and second antennas 310 and 320, respectively.

The first and second connection portions 410, 420*a* and 420*b* may form a is metal layer on the inner surface of the rear case 203. The metal layer may be implemented as a metal plate and a metal sheet.

Referring to FIG. 7C, to electrically connect the connection unit 400 to the first and second antennas 310 and 320 by electromagnetic induction, the second connection portions 420*a* and 420*b* may be disposed at portions adjacent to the feed parts 312 and 322 or the ground parts 313 and 323 of the first and second antennas 310 and 320, respectively, with a spaced distance therebetween.

Also, the second connection portions 420*a* and 420*b* may be disposed to be partially connected to the portions adjacent to the feed parts 312 and 322 or the ground parts 313 and 323 of the first and second antennas 310 and 320, respectively. This may prevent the second connection portions 420*a* and 420*b* from interfering with wireless signals radiated from the first and second antennas 310 and 320 due to both being entirely connected to the radiation parts 311 and 321.

As such, the first and second connection portions, especially, the second connection portion for electrically connecting the antennas may be named a neutralization line, a decoupling line or a phase shift line for offsetting the frequency interference between the plurality of antennas.

In the meantime, although not shown, when the first and second connection portions 410 and 420 are spaced apart from the first and second antennas 310 and 320 by the same distance, the first connection portion 410 may be formed on another plate to prevent the first connection portion 410 from being disposed on the same position as the first and second antennas 310 and 320 on a plane. This may result in preventing the first and second antennas 310 and 320 from being interfered by the metallic property of the first connection portion 410.

As described above, in the portable terminal according to the present disclosure, the coupling or connection between the antennas and the connection unit may change in various manners according to a position at which the connection unit is disposed on the terminal. This may prevent the structure of the connection unit from interfering with the internal structure of the terminal.

Also, in the portable terminal according to the present disclosure, a plurality of antennas may be electrically connected by a metal member formed along an edge of the terminal body, thereby effectively lowering a coupling coefficient between the antennas. As such, as the antennas are connected via the metal member formed along the edge of the terminal body, a separate device which occupies a predetermined space within the terminal for minimizing coupling between the antennas may not be required or a spaced distance between the antennas may not be needed. This may result in effective arrangement of MIMO antennas which require a plurality of antenna devices within a small space such as a small terminal.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the is above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A portable terminal comprising:

a terminal body;

a first antenna mounted in the terminal body to transmit or receive a wireless signal;

a second antenna disposed with being spaced apart from the first antenna and set to transmit or receive a wireless signal at a frequency band different from the first antenna; and a connection unit configured to electrically connect the first and second antennas to reduce a frequency interference between the first and second antennas, wherein the connection unit comprises:

a first connection portion exposed to the outside of the terminal body, and the exposed portion extending to surround every edge of the side surface of the terminal body, starting from one point, thereby forming a closed loop and made of a conductive material; and a second connection portion disposed between the first and second antennas and the first connection portion to electrically connect the first and second antennas to the first connection portion, wherein the first and second antennas are formed in the terminal body such that the first and second antennas are not exposed to the outside, and wherein the second connection portion is a neutralization line to improve an isolation of the first and second antennas.

2. The terminal of claim 1, wherein the second connection portion is formed integrally with the first connection portion and protrudes from the first connection portion into the terminal body, or implemented as a flexible printed circuit board or a cable formed separate from the first connection portion.

3. The tetiuinal of claim 1, wherein the first connection portion is mounted onto one surface of a case of the terminal body.

4. The terminal of claim 1, wherein a printed circuit board is mounted in the terminal body to process wireless signals of the first and second antennas, wherein the first and second antennas comprise first and second feed parts connected to the printed circuit board, respectively, and wherein the connection unit is electrically connected to a portion adjacent to the first feed part and a portion adjacent to the second feed part, respectively.

5. The terminal of claim 1, wherein the first and second antennas comprise first and second ground parts connected to the ground, respectively, and wherein one end of the connection unit is connected to portions adjacent to the first and second ground parts, respectively.

6. The terminal of claim 1, wherein the connection unit is connected to a portion adjacent to a first feed part or a portion adjacent to the ground part of the first antenna connected to a printed circuit board, the printed circuit board mounted in the terminal body for processing a wireless signal of the first antenna, and wherein the connection unit is connected to a portion adjacent to a second feed part or a portion adjacent to the ground part of the second antenna connected to the printed circuit board, the printed circuit board mounted in the terminal body for processing a wireless signal of the second antenna.

7. The terminal of claim 1, wherein the first and second antennas are disposed along one side of a side surface of the terminal body with a spaced distance therebetween, and wherein the connection unit is formed along the one side to electrically connect the first and second antennas to each other.

8. The terminal of claim 7, wherein at least part of the connection unit is curved from one side of the side surface of the terminal body toward another side perpendicular to the one side, and wherein the connection unit extends to a third antenna disposed along the one side to electrically connect the second antenna and the third antenna to each other.

9. The terminal of claim 1, wherein at least one of the first and second antennas is disposed at positions adjacent to the connection unit, with a spaced distance therebetween, so as to be coupled to the connection unit.

10. A portable terminal comprising:

a terminal body having a front surface, a side surface and a rear surface;

a window disposed on the front surface;

a metal member formed to be exposed to the outside of at least one of the front surface, the side surface and the rear surface, the metal member made of a conductive material to provide a different type of texture from the window;

a plurality of antennas mounted in the terminal body to transmit or receive wireless signals, respectively; and an extending portion extending from the metal member into the terminal body to be connected to the plurality of antennas, respectively, wherein the extending portion is a neutralization line to improve an isolation of the plurality of antennas, wherein the metal member exposed to the outside of the terminal body forms a closed loop along an edge of the terminal body, and wherein the plurality of antennas are not exposed to the outside.

11. The terminal of claim 10, wherein the metal member is electrically connected to the plurality of antennas, respectively, at both ends thereof, and a logo is formed between the both ends, and wherein the logo is exposed to at least one of the front surface and the rear surface of the terminal body.

* * * * *